US008947479B2

(12) United States Patent
Mizutani

(10) Patent No.: US 8,947,479 B2
(45) Date of Patent: Feb. 3, 2015

(54) DEVICE FOR ERASING AND COOLING A SHEET

(71) Applicants: Kabushiki Kaisha Toshiba, Tokyo (JP); Toshiba Tec Kabushiki Kaisha, Tokyo (JP)

(72) Inventor: Kikuo Mizutani, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/185,642

(22) Filed: Feb. 20, 2014

(65) Prior Publication Data

US 2014/0240433 A1 Aug. 28, 2014

(30) Foreign Application Priority Data

Feb. 26, 2013 (JP) ..... 2013-036177

(51) Int. Cl.
*B41J 2/325* (2006.01)
*B41J 2/375* (2006.01)
*B41J 29/36* (2006.01)

(52) U.S. Cl.
CPC ..... *B41J 29/36* (2013.01)
USPC ..... 347/179; 347/223

(58) Field of Classification Search
USPC ..... 347/129, 171, 223
See application file for complete search history.

(56) References Cited

U.S. PATENT DOCUMENTS

| | | | | |
|---|---|---|---|---|
| 7,405,744 | B2 * | 7/2008 | Denawa | 347/171 |
| 7,884,840 | B2 * | 2/2011 | Sohmiya et al. | 347/171 |
| 2001/0022610 | A1 * | 9/2001 | Ozawa | 347/223 |
| 2004/0017467 | A1 * | 1/2004 | Torisawa | 347/223 |
| 2010/0272449 | A1 | 10/2010 | Yoshida et al. | |
| 2011/0222130 | A1 | 9/2011 | Iguchi et al. | |
| 2012/0306985 | A1 | 12/2012 | Iguchi et al. | |

FOREIGN PATENT DOCUMENTS

| | | |
|---|---|---|
| EP | 1162518 | 12/2001 |
| JP | H08-30154 | 2/1996 |
| JP | H11-305615 | 11/1999 |
| JP | 2010253951 | 11/2010 |

* cited by examiner

*Primary Examiner* — Kristal Feggins
(74) *Attorney, Agent, or Firm* — Patterson & Sheridan LLP.

(57) ABSTRACT

A device for erasing an image on a sheet includes a reading unit that reads an image formed on a sheet. An erasing unit erases the image formed on the sheet by heating the sheet after the sheet has passed through the reading unit. A conveyance path conveys the sheet from the erasing unit back to the reading unit. The conveyance path includes a curved portion between the erasing unit and the reading unit. A cooling unit cools the sheet which passes through the conveyance path. The cooling unit includes at least one fan that supplies cooling air generally along a sheet conveying direction. A rate of the cooling air supplied to an outer peripheral portion of the curved portion of the conveyance path is larger than a rate of the cooling air supplied to an inner peripheral portion of the curved portion of the conveyance path.

20 Claims, 6 Drawing Sheets

DEVICE FOR ERASING AND COOLING A SHEET

CROSS-REFERENCE TO RELATED APPLICATION

This application is based upon and claims the benefit of priority from Japanese Patent Application No. 2013-036177, filed Feb. 26, 2013, the entire contents of which are incorporated herein by reference.

FIELD

Embodiments described herein relate generally to a device and method for erasing and cooling a sheet on which an image is formed by an image forming apparatus.

BACKGROUND

Conventionally, an image forming apparatus such as a Multi Function Peripheral (MFP) is used to form an image on a sheet (paper). For enabling the reuse of the sheet by erasing an image formed on the sheet, there exists a technique where an image is printed on the sheet using a coloring agent having a decoloring property, such as ink containing a leuco dye.

A coloring agent having decoloring property is erased when the coloring agent is subjected to a high temperature. Accordingly, to reuse a sheet, the sheet is heated using an erasing device, thus erasing an image formed on the sheet. The erasing of an image formed on a sheet may be referred to as "decoloring" in the explanation made hereinafter.

In the erasing device, a platen roller and a heat source are arranged in an opposed manner with a sheet conveyance path interposed between the platen roller and the heat source. The sheet is heated by conveying the sheet between the platen roller and the heat source, thus erasing a coloring agent having decoloring property. A cooling fan for cooling the device is mounted downstream of the platen roller and the heat source. Accordingly, the sheet which is conveyed along a conveyance guide is cooled by air from the cooling fan.

However, when the sheet conveyance path includes a curve, the sheet is pressed to an outer side of the curve thus giving rise to a drawback that a jam is liable to occur. Although this drawback may be overcome by increasing a radius of the curve, there arises a drawback that the device becomes large-sized.

DETAILED DESCRIPTION

According to an embodiment, a device is provided for erasing an image on a sheet which may decrease the occurrence of a jam by efficiently cooling the sheet after decoloring.

A device for erasing an image on a sheet includes a reading unit that reads an image formed on a sheet. An erasing unit erases the image formed on the sheet by heating the sheet after the sheet has passed through the reading unit. A conveyance path conveys the sheet from the erasing unit back to the reading unit. The conveyance path includes a curved portion between the erasing unit and the reading unit. A cooling unit cools the sheet which passes through the conveyance path. The cooling unit includes at least one fan that supplies cooling air generally along a sheet conveying direction. An outer air flow rate of the cooling air supplied to an outer peripheral portion of the curved portion of the conveyance path is larger than an inner air flow rate of the cooling air supplied to an inner peripheral portion of the curved portion of the conveyance path.

Hereinafter, exemplary embodiments are explained with referring to drawings. In the respective drawings, identical parts are given the same symbols.

(First Embodiment)

Figure 1:
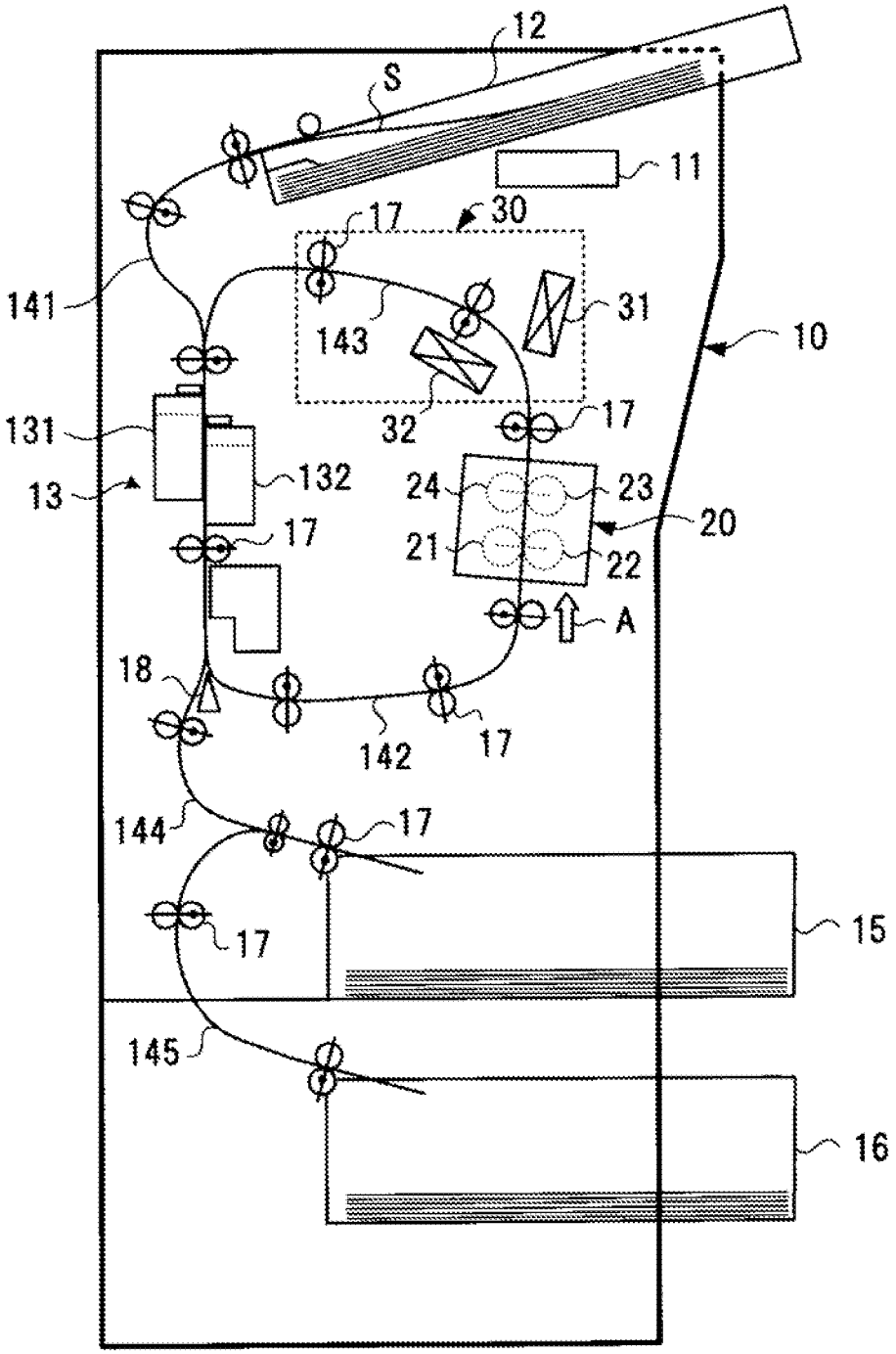
FIG. 1 illustrates a device for erasing an image on a sheet, according to a first embodiment.

FIG. 1 illustrates an erasing device 10 for erasing an image on a sheet according to the first embodiment. The erasing device 10 includes: an operation panel 11 having operation buttons and a display unit, a sheet feeding unit 12, a scanner 13 (reading unit); and an erasing unit 20. The erasing device 10 also includes: a first conveyance path 141, a second conveyance path 142, a third conveyance path 143, a fourth conveyance path 144, a fifth conveyance path 145, a first sheet discharge tray 15, and a second sheet discharge tray (reject box) 16.

The conveyance paths 141 to 145 include a plurality of conveyance rollers 17 for conveying sheets. The plurality of conveyance rollers 17 are each driven by motors, respectively. A gate 18 is provided for sorting the conveyance of sheets between the conveyance path 142 and the conveyance path 144 respectively.

The first conveyance path 141 conveys a sheet S to the scanner 13 from the sheet feeding unit 12. The second conveyance path 142 conveys the sheet S toward the erasing unit 20 from the scanner 13 in the direction indicated by an arrow A. The third conveyance path 143 conveys the sheet S to the scanner 13 again from the erasing unit 20. The fourth conveyance path 144 conveys the sheet S to the first sheet discharge tray 15 from the scanner 13. The fifth conveyance path 145 conveys the sheet S to a reject box 16 from the scanner 13. The first sheet discharge tray 15 collects reusable sheets, for example, after the decoloring processing is applied to an image. The reject box 16 collects sheets which are not reusable and are to be discarded/recycled.

The erasing device 10 shown in FIG. 1 performs the following operations (1) to (5) described below.

(1) When a mode of decoloring and reading a sheet S is selected by a user using the operation panel 11, the sheet S is fed from the sheet feeding unit 12. The sheet S is then conveyed to the scanner through the first conveyance path 141. The scanner 13 scans an image on the sheet S and generates image data corresponding to the image, before the image on the sheet S is decolored. The scanner 13 includes a first scanner 131 and a second scanner 132 so that the scanner 13 reads both surfaces of the sheet S. The erasing device 10 also acquires a printing state of the sheet S, based on, for example, an identification of breakage or wrinkles from the image data generated by the scanner 13. The erasing device 10 may also acquire a printing rate of the sheet S, indicated by, for example, markings on the sheet S printed with non-erasable toner which are included in the image data generated by the scanner 13.

(2) The erasing device 10 stores the image data read by the scanner 13 or the like. When it is detected that the sheet S has breakages or wrinkles based on a printing state determined from the image data read by the scanner 13, or when it is determined that the sheet S has a high printing rate, the sheet S is introduced into the fifth conveyance path 145 and is conveyed to the reject box 16. A sheet which has a high printing rate is liable to be curled at the time of decoloring and hence, such a sheet is conveyed to the reject box 16. The sheet S determined to have no wrinkles and no breakages is conveyed to the erasing unit 20 through the second conveyance path 142.

(3) The sheet S conveyed to the erasing unit 20 is heated while passing through the erasing unit 20 and the image formed on the sheet S is decolored by heat. That is, the erasing unit 20 decolors the image on the sheet S by applying heat and pressure to the sheet S at a relatively high temperature of 180 to 200° C., for example. Thus, the image is formed on the sheet S using a coloring agent which may be decolored, and the coloring agent is decolored when the coloring agent reaches a predetermined temperature. In this manner, the coloring agent is decolored by conveying the sheet S to the erasing unit 20 where the sheet S is heated at a predetermined temperature at a preset conveyance speed.

(4) The sheet S which passes through the erasing unit 20 is conveyed to the scanner 13 again through the third conveyance path 143. The scanner 13 scans the surfaces of the sheet and generates image data again to determine a printing state again so as to confirm whether or not an image formed using a coloring agent having decoloring property is sufficiently decolored. The sheet S is then sorted accordingly.

(5) The reused sheet S is conveyed to the first sheet discharge tray 15 through the fourth conveyance path 144. Based on a printing state determined from the image data generated by the scanner 13, when it is determined that the image formed using a coloring agent having non-decoloring property or an image formed by handwriting remains in an image region of the sheet S or the sheet S has breakages or wrinkles, the sheet S is conveyed to the reject box 16 through the fifth conveyance path 145.

The erasing unit 20 includes a first erasing unit having a heat roller 21 and a press roller 22, and a second erasing unit having a press roller 23 and a heat roller 24. In the erasing unit 20, the sheet S is conveyed between the heat roller 21 and the press roller 22 and between the press roller 23 and the heat roller 24, and heats the sheet S. The heat rollers 21, 24 each respectively have a heat source therein. The heat rollers 21, 24 also each respectively have a temperature detection unit on an outer periphery thereof. A lamp may be used as the heat source, for example. The heat source of the first erasing unit has a heat capacity larger than that of the heat source of the second erasing unit.

The cooling unit 30 includes cooling fans 31, 32. The cooling unit 30 lowers a temperature of the heated sheet S and is arranged along the conveyance path for the sheet S downstream of erasing unit 20.

In a case where a temperature of a sheet S is high when the sheet S is conveyed to the scanner 13 again for sorting after the sheet S is decolored, a toner on the sheet S may adhere to a glass surface of the scanner 13 so that the quality of a scanned image is deteriorated. Accordingly, the fans 31, 32 are powered so as to supply cooling air to the conveyance path 143 for the sheet S, thus cooling the sheet S.

Figure 2:
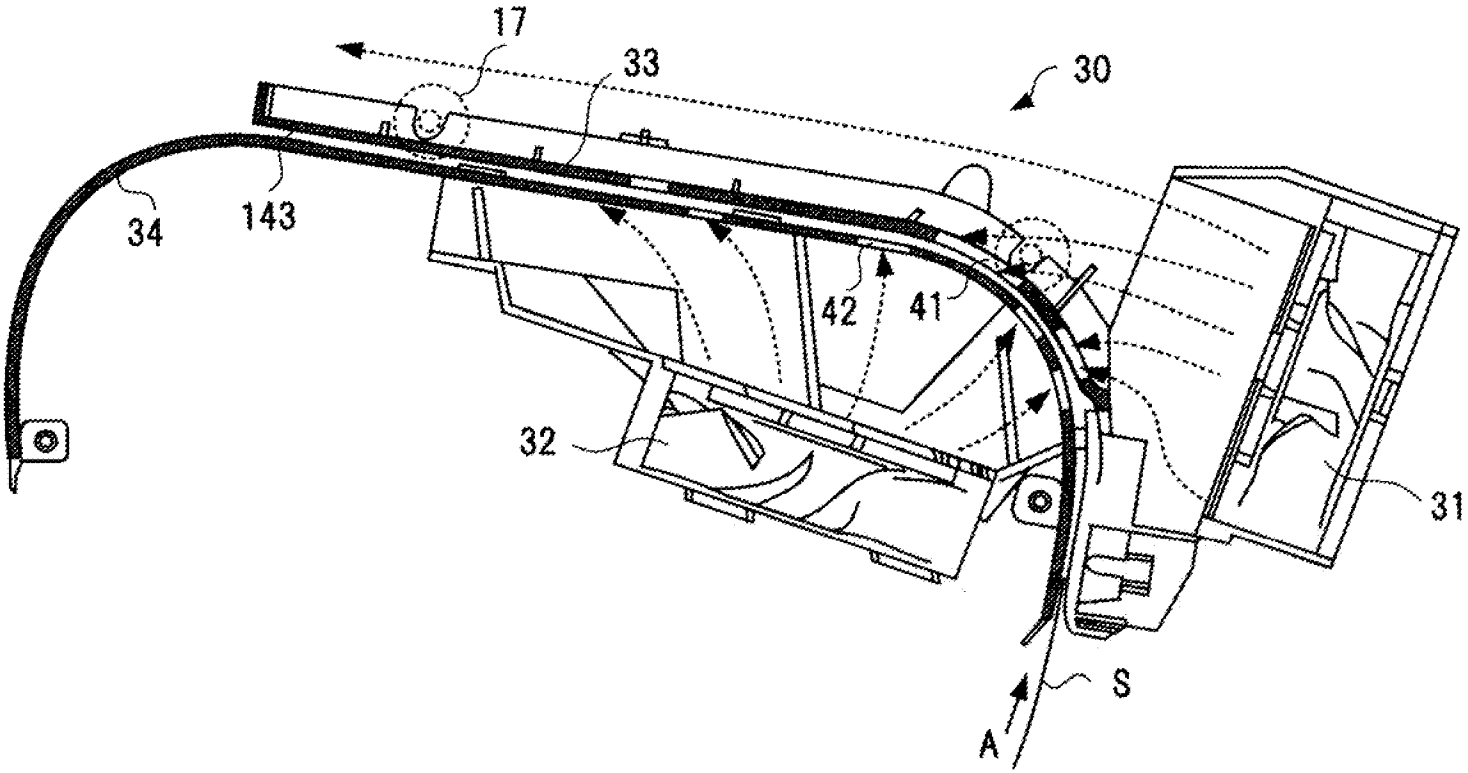
FIG. 2 is a cross-sectional view showing a cooling unit of the device, according to the first embodiment.
Figure 3:
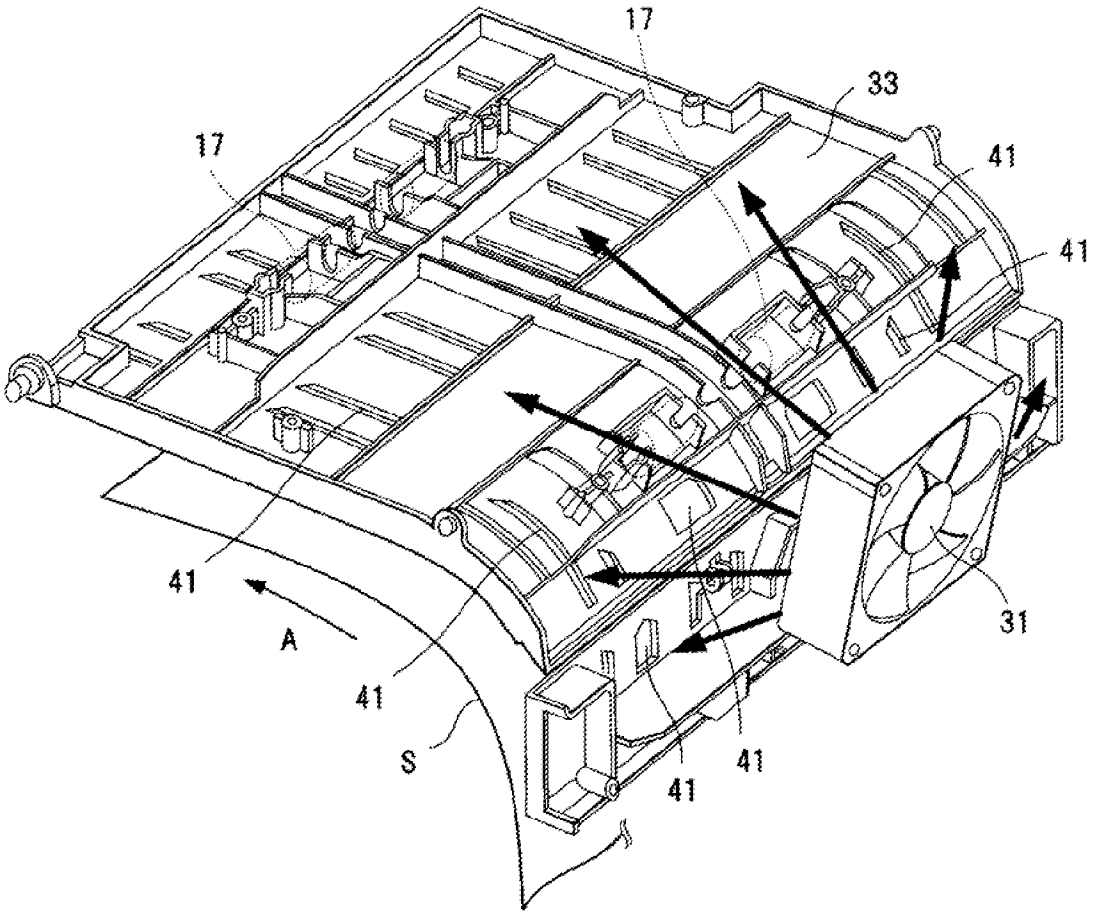
FIG. 3 is a perspective view showing an upper guide plate and a fan of the cooling unit, according to the first embodiment.

Next, the arrangement of the cooling unit 30 is explained with referring to FIG. 2 and FIG. 3.

FIG. 2 is a cross-sectional view of the cooling unit 30. An upper guide plate 33 and a lower guide plate 34 are arranged to face each other in an opposed manner. A preset gap is between the upper guide plate 33 and the lower guide plate 34 for forming the conveyance path 143 for a sheet S. Hereinafter, the upper guide plate 33 is referred to as an upper guide 33, and the lower guide plate 34 is referred to as a lower guide 34.

For guiding a sheet S discharged from the erasing unit 20 to the scanner 13 (FIG. 1), the upper guide 33 and the lower guide 34 are curved in an arc toward the scanner 13 from the erasing unit 20 so that the sheet S is conveyed in the direction indicated by an arrow A while passing through between the upper guide 33 and the lower guide 34. The fan 31 is arranged outside a curved surface of the upper guide 33. When the fan 31 is powered, cooling air from the fan 31 flows toward a downstream side of the conveyance path from the curved surface of the upper guide 33.

On the other hand, the fan 32 is arranged outside the curved surface of the lower guide 34. When the fan 32 is powered, cooling air from the fan 32 flows toward a downstream side of the conveyance path from the curved surface of the lower guide 34. That is, in the cooling unit 30, the first fan 31 and the second fan 32 are arranged on both sides of the third conveyance path 143 respectively, centered on the third conveyance path 143.

A plurality of slits 41 are formed in the upper guide 33 for allowing air from the fan 31 to flow into the conveyance path 143. Likewise, a plurality of slits 42 are formed in the lower guide 34 for allowing air from the fan 32 to flow into the conveyance path 143. Air from the fan 31 passes on an upper surface of the upper guide 33, and flows into the conveyance path 143 through the slits 41. Air from the fan 31 also flows toward a downstream side of the conveyance path 143. Air from the fan 32 passes on a lower surface of the lower guide 34, and flows into the conveyance path 143 through the slits 42. Air from the fan 31 also flows toward a downstream side of the conveyance path 143. The sheet S in the conveyance path 143 is cooled by air which flows into the conveyance path 143 from upper and lower sides through the slits 41, 42. Thereafter, the cooled sheet S is conveyed to the scanner 13.

FIG. 3 is a perspective view showing the upper guide 33 of the cooling unit 30 as viewed in the direction from the fan 31. As shown in FIG. 3, the plurality of slits 41 are formed in the upper guide 33 for supplying air from the fan 31 into the conveyance path 143. The plurality of slits 41 are formed in an elongated manner along the conveyance direction A of a sheet S. A plurality of conveyance rollers 17 are mounted on the upper guide 33 along the conveyance path 143 for conveying a sheet S. Air from the fan 31 flows toward the upper guide 33 in a radially spreading manner from the fan 31 as indicated by a bold arrow. The air flows into the conveyance path 143 through the plurality of slits 41.

Although not shown in FIG. 3, in the same manner as the upper guide 33, the plurality of slits 42 are formed in the lower guide 34 for supplying air from the fan 32 into the conveyance path 143. Air from the fan 32 flows toward the lower guide 34 in a radially spreading manner. The air flows into the conveyance path 143 through the plurality of slits 42. Accordingly, a sheet S is cooled from both surfaces of the conveyance path 143.

The third conveyance path 143 is curved toward the scanner 13 from the erasing unit 20. Accordingly, a sheet S is pressed to an outer side of the curved conveyance path 143 thus giving rise to the possible occurrence of a jam, which is undesirable.

Figure 4:
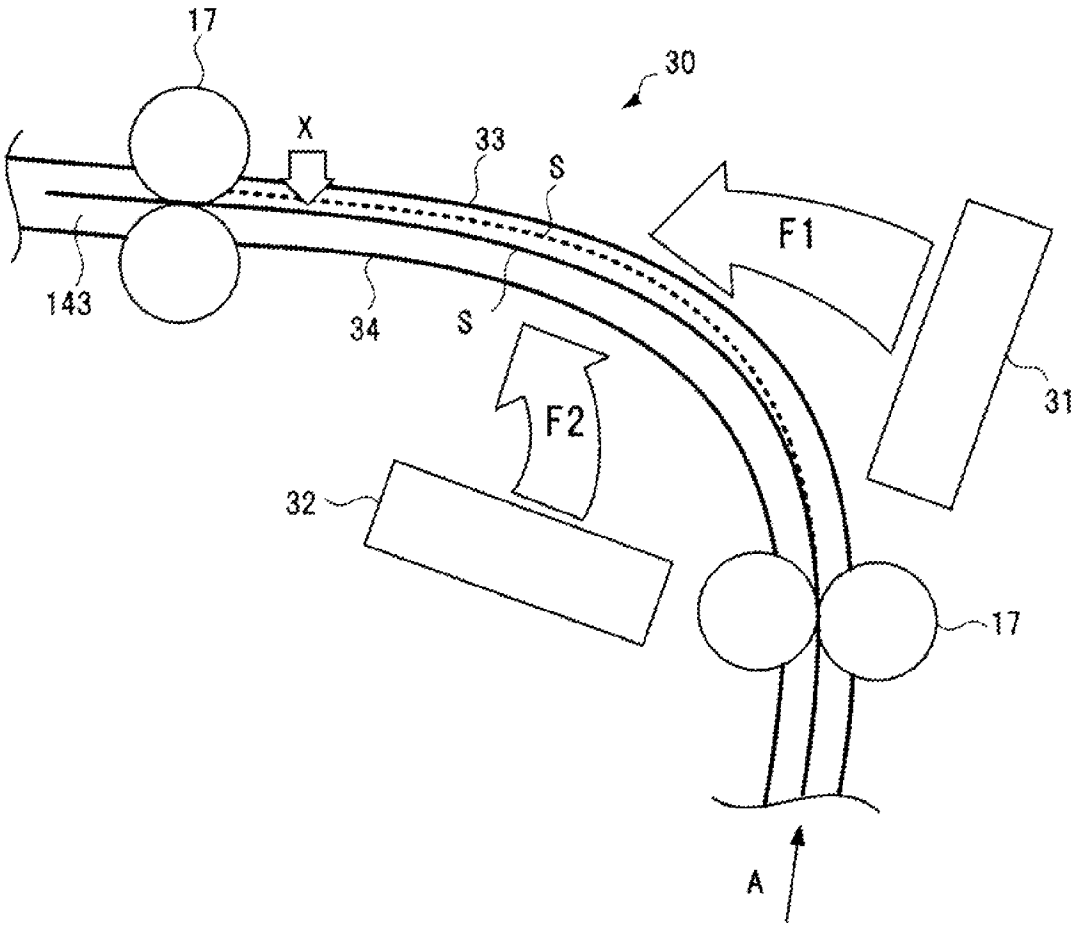
FIG. 4 is a cross-sectional view showing an occurrence of a jam in the cooling unit, and a countermeasure for the jam, according to the first embodiment.

FIG. 4 is a cross-sectional view showing the occurrence of a jam and a countermeasure for the jam. The third conveyance path 143 is curved and hence, a sheet S conveyed from the erasing unit 20 is pressed to an upper guide 33 side. Accordingly, as indicated by a dotted line in FIG. 4, there exists a possibility that the sheet S impinges on a portion of the conveyance roller 17 above a nip point of the conveyance rollers 17 so that a jam occurs.

In the first embodiment, the fans 31, 32 are arranged on the outer peripheral side and the inner peripheral side of the conveyance path 143 respectively so that the sheet S is cooled from both surfaces. That is, a front surface and a back surface of the sheet S are cooled by the fans 31, 32. To prevent the occurrence of a jam, an amount of cooling air from the fan 31 arranged on the outer peripheral side is set larger than an amount of cooling air from the fan 32 arranged on the inner peripheral side. That is, assuming an air flow rate supplied to the outer peripheral portion of the conveyance path 143 as F1 and an air flow rate supplied to the inner peripheral portion of the conveyance path 143 as F2, the relationship of F1>F2 is established.

By setting the air flow rate F1 supplied to the outer peripheral portion and the air flow rate F2 supplied to the inner peripheral portion such that the relationship of F1>F2 is satisfied, as indicated by an arrow X, the sheet S is pressed in the direction toward the inner side of the conveyance path 143 (indicated by a solid line). Accordingly, the fans 31, 32 may assist the conveyance of the sheet S such that the sheet S is conveyed toward the nip point of the conveyance rollers 17. Accordingly, the sheet S passes between the conveyance rollers 17 without occurrence of a jam. The sheet S is conveyed to the scanner 13 after both surfaces of the sheet S are cooled by the fan 31 and the fan 32. Hence, it is possible to prevent toner or ink from adhering to the glass surface of the scanner 13. Further, a radius of the curve of the conveyance path 143 may be decreased, and the erasing device may be miniaturized.

As a method for setting the air flow rate F1 supplied to the outer peripheral portion and the air flow rate F2 supplied to the inner peripheral portion to satisfy the relationship of F1>F2, when the fans 31, 32 are formed using the same type of fan, a rotational speed of the fan 31 may be set higher than a rotational speed of the fan 32. Alternatively, mounting positions of the fans 31, 32 may be set such that the fan 31 is arranged close to the conveyance path 143 and the fan 32 is arranged slightly away from the conveyance path 143. The number of slits 41 formed in the upper guide 33 may be set larger than the number of slits 42 formed in the lower guide 34. Further, both fans 31, 32 may be powered at the same rotational speed while setting a size of the fan 31 larger than a size of the fan 32. Still further, a rotational speed of the fan 31 may be set higher than a rotational speed of the fan 32 while setting a size of the fan 31 equal to a size of the fan 32.

(Second Embodiment)

Next, an arrangement of a cooling unit 30 according to a second embodiment is explained.

Figure 5:
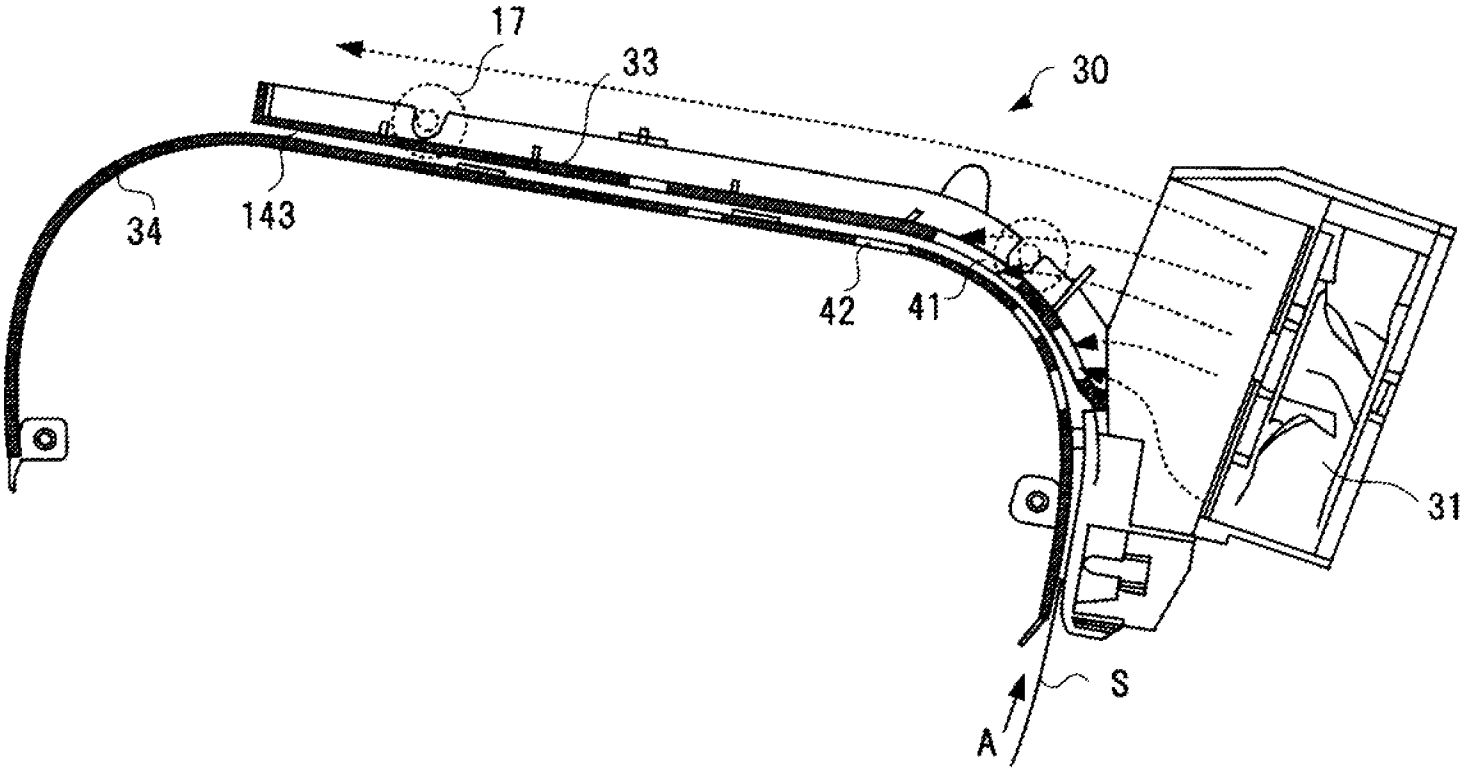
FIG. 5 is a cross-sectional view showing a cooling unit of a device for erasing an image on a sheet, according to a second embodiment.

FIG. 5 is a cross-sectional view showing the constitution of the cooling unit 30 according the second embodiment. This embodiment is characterized in that only the fan 31 is provided, and a second fan, i.e., fan 32, is not provided. That is, the fan 31 is arranged on an outer peripheral side of a third conveyance path 143 which is formed between an upper guide 33 and a lower guide 34.

Figure 6:
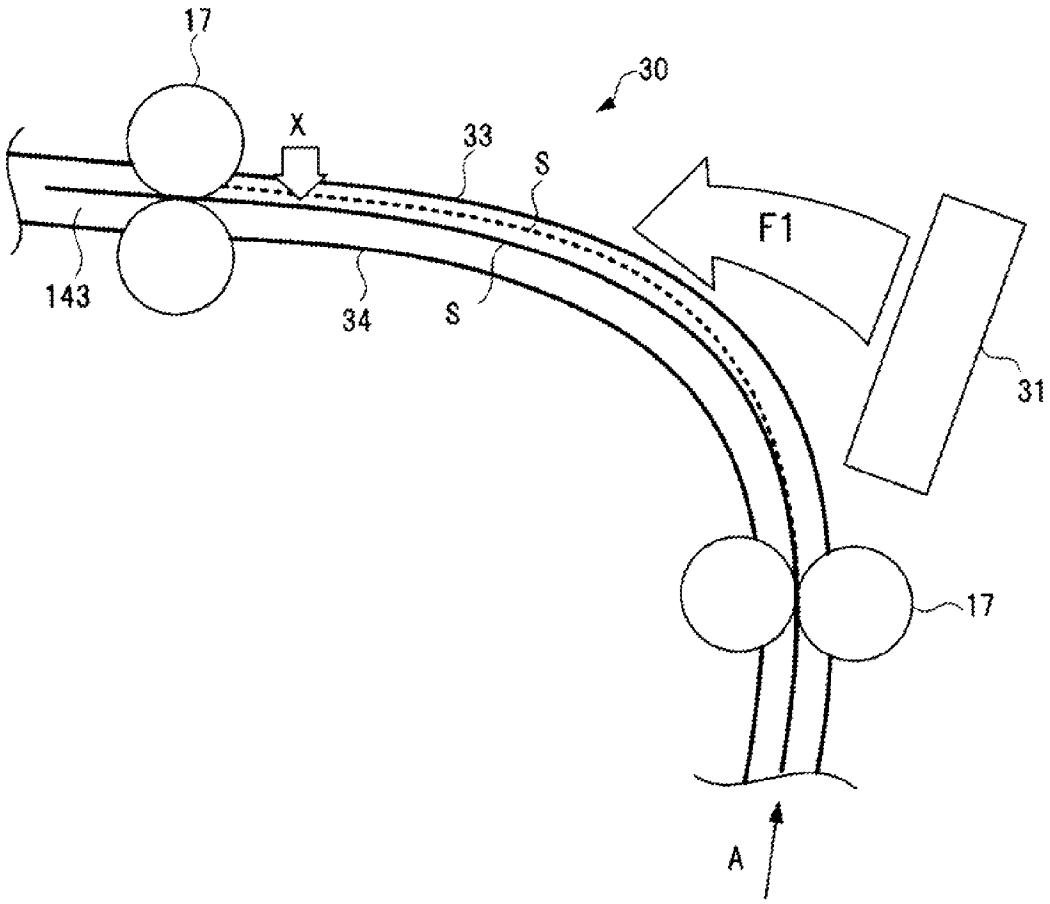
FIG. 6 is a cross-sectional view showing an occurrence of a jam in the cooling unit, and a countermeasure for the jam, according to the second embodiment.

FIG. 6 is a cross-sectional view showing the occurrence of a jam and a countermeasure for the jam. The third conveyance path 143 is curved so that a sheet S which is conveyed from an erasing unit 20 is pressed to an upper guide 33 side. Then, the fan 31 is arranged on the outer peripheral side of the conveyance path 143, and the sheet S is cooled by powering the fan 31.

Although the sheet S is originally pressed to the upper guide 33 side, air from the fan 31 presses the sheet S in the direction toward an inner side of the conveyance path 143 (indicated by a solid line). Accordingly, the fan 31 may assist the conveyance of the sheet S such that the sheet S is conveyed toward a nip point of conveyance rollers 17. Accordingly, the sheet S passes between the conveyance rollers 17 without occurrence of a jam.

According to the above-mentioned embodiments described heretofore, even when the conveyance path for a sheet S is curved, the occurrence of a jam may be reduced. Further, the sheet S may be efficiently cooled so that heat is not accumulated in the conveyance path 143 for the sheet S. With this arrangement, the reading unit 13 is not subject to toner on the sheet S adhering to the glass surface of the scanner 13. Thus, the quality of a scanned image is not reduced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein maybe made without departing from the spirit of the inventions. The accompanying claims and their equivalents are intended to cover such forms or modifications as would fall within the scope and spirit of the inventions.

What is claimed is:

1. A device for erasing an image on a sheet comprising:

a reading unit configured to read an image formed on a sheet;

an erasing unit configured to erase the image formed on the sheet by heating the sheet after the sheet has passed through the reading unit;

a conveyance path configured to convey the sheet from the erasing unit back to the reading unit, the conveyance path including a curved portion between the erasing unit and the reading unit; and a cooling unit configured to cool the sheet which passes through the conveyance path, the cooling unit including at least one fan that supplies cooling air generally along a sheet conveying direction, wherein an outer air flow rate of the cooling air supplied to an outer peripheral portion of the curved portion of the conveyance path is larger than an inner air flow rate of the cooling air supplied to an inner peripheral portion of the curved portion of the conveyance path.

2. The device according to claim 1, wherein the conveyance path includes a first guide plate and a second guide plate, each having a plurality of slits formed therein.

3. The device according to claim 2, wherein a number of the slits formed in the first guide plate on an outer side of the conveyance path is larger than a number of slits formed in the second guide plate on an inner side of the conveyance path.

4. The device according to claim 1, wherein the cooling part includes, a first fan centered on the conveyance path with respect to a direction transverse to the sheet conveying direction and positioned to supply the cooling air to the outer peripheral portion of the curved portion of the conveyance path at the outer air flow rate, and a second fan centered on the conveyance path with respect to the direction transverse to the sheet conveying direction and positioned to supply the cooling air to the inner peripheral portion of the curved portion of the conveyance path at the inner air flow rate.

5. The device according to claim 4, wherein the first fan is larger than the second fan so that outer air flow rate is larger than the inner air flow rate.

6. The device according to claim 4, wherein the first fan is controlled to rotate faster than the second fan so that outer air flow rate is larger than the inner air flow rate.

7. The device according to claim 1, wherein the at least one fan comprises a single fan configured to supply cooling air to the outer peripheral portion of the curved portion of the conveyance path.

8. A method for cooling a sheet comprising the steps of:

conveying, on a conveyance path, the sheet from a first unit to a second unit, the conveyance path including a curved portion between the first unit and the second unit; and cooling, with a cooling unit, the sheet which passes through the conveyance path, the cooling unit including at least one fan that supplies cooling air generally along a sheet conveying direction, wherein an outer air flow rate of the cooling air supplied to an outer peripheral portion of the curved portion of the conveyance path is larger than an inner air flow rate of the cooling air supplied to an inner peripheral portion of the curved portion of the conveyance path.

9. The method according to claim 8, wherein the conveyance path includes a first guide plate and a second guide plate, each having a plurality of slits formed therein.

10. The method according to claim 9, wherein a number of the slits formed in the first guide plate on an outer side of the conveyance path is larger than a number of slits formed in the second guide plate on an inner side of the conveyance path.

11. The method according to claim 8, wherein the cooling part includes a first fan centered on the conveyance path with respect to a direction transverse to the sheet conveying direction, that supplies the cooling air to the outer peripheral portion of the curved portion of the conveyance path at the outer air flow rate, and a second fan centered on the conveyance path with respect to a direction transverse to the sheet conveying direction, that supplies the cooling air to the inner peripheral portion of the curved portion of the conveyance path at the inner air flow rate.

12. The method according to claim 11, wherein the first fan is larger than the second fan so that outer air flow rate is larger than the inner air flow rate.

13. The method according to claim 11, wherein the first fan is controlled to rotate faster than the second fan so that outer air flow rate is larger than the inner air flow rate.

14. The method according to claim 8, wherein the at least one fan comprises a single fan that supplies cooling air to the outer peripheral portion of the curved portion of the conveyance path.

15. A device for cooling a sheet comprising:

a conveyance path configured to convey the sheet from a first unit to a second unit, the conveyance path including a curved portion between the first unit and the second unit; and a cooling unit configured to cool the sheet which passes through the conveyance path, the cooling unit including at least one fan that supplies cooling air generally along a sheet conveying direction, wherein an outer air flow rate of the cooling air supplied to an outer peripheral portion of the curved portion of the conveyance path is larger than an inner air flow rate of the cooling air supplied to an inner peripheral portion of the curved portion of the conveyance path.

16. The device according to claim 15, wherein the conveyance path includes a first guide plate and a second guide plate, each having a plurality of slits formed therein.

17. The device according to claim 15, wherein the cooling part includes a first fan centered on the conveyance path with respect to a direction transverse to the sheet conveying direction and positioned to supply the cooling air to the outer peripheral portion of the curved portion of the conveyance path at the outer air flow rate, and a second fan centered on the conveyance path with respect to a direction transverse to the sheet conveying direction and positioned to supply the cooling air to the inner peripheral portion of the curved portion of the conveyance path at the inner air flow rate.

18. The device according to claim 17, wherein the first fan is larger than the second fan so that outer air flow rate is larger than the inner air flow rate.

19. The device according to claim 17, wherein the first fan is controlled to rotate faster than the second fan so that outer air flow rate is larger than the inner air flow rate.

20. The device according to claim 15, wherein the at least one fan comprises a single fan configured to supply cooling air to the outer peripheral portion of the curved portion of the conveyance path.

* * * * *